US006300299B1

(12) United States Patent
Murphy et al.

(10) Patent No.: US 6,300,299 B1
(45) Date of Patent: Oct. 9, 2001

(54) PROCESS FOR CLEANING TURMERIC STAINS

(75) Inventors: Peter M Murphy, Ooltewah; Misty D Dittman, Cleveland, both of TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/777,346

(22) Filed: Feb. 6, 2001

(51) Int. Cl.[7] ..... C11D 17/04; D06L 3/02; D06L 17/04

(52) U.S. Cl. ..... 510/278; 510/280; 8/111

(58) Field of Search ..... 510/278, 280; 8/111

(56) References Cited

U.S. PATENT DOCUMENTS

| | | |
|---|---|---|
| 3,607,760 | 9/1971 | McIntyre . |
| 4,186,031 | 1/1980 | Armstrong et al. . |
| 5,250,211 | 10/1993 | Motsenbocker . |
| 5,252,243 | 10/1993 | Minns . |
| 5,259,848 | 11/1993 | Terry et al. . |
| 5,338,475 | 8/1994 | Corey et al. . |
| 5,348,556 | 9/1994 | Minns et al. . |
| 5,389,278 | 2/1995 | Minns et al. . |
| 5,492,540 | 2/1996 | Leifheit et al. . |
| 5,522,580 | 6/1996 | Varner, Jr. et al. . |
| 5,728,669 | 3/1998 | Tyerech . |
| 5,905,065 | 5/1999 | Scialla et al. . |
| 5,997,585 | 12/1999 | Scialla et al. . |
| 6,013,139 | 1/2000 | Tarkinson . |

FOREIGN PATENT DOCUMENTS

| | | |
|---|---|---|
| 346835 | 7/1994 | (EP) . |
| 2321251 | 7/1998 | (GB) . |
| 62025198 | 2/1987 | (JP) . |

OTHER PUBLICATIONS

Laura Helmuth, *Profiles in Chemistry*, Today's Chemist at Work, Feb. 2000, p. 111–113.
Internet Reference: http://www.webopages.com/plush/mustard.html May 11, 2000.
Internet Reference: http://www.fabriclink.com/Carpet/Untreatable.html May 11, 2000.
Internet Reference: http://www.marsons.com/spsptg.html May 11, 2000.

*Primary Examiner*—Gregory DelCotto
*Assistant Examiner*—John M Petruncio

(57) ABSTRACT

A process for removing turmeric stains from nylon or wool articles comprising (a) applying a solution of an oxidizing agent to the stained area, and (b) exposing the stained area to light of ultraviolet wavelength is disclosed.

7 Claims, No Drawings

PROCESS FOR CLEANING TURMERIC STAINS

BACKGROUND OF THE INVENTION

The prevention and removal of stains on carpeting and other fabrics is a major concern. However, one particular stain, turmeric, such as in mustard, has been found to be extremely difficult both to prevent and remove, particularly from nylon and wool. Available treatments for providing stain resistance and spill repellency do not protect adequately from such stains. The difficulty experienced in the prevention and removal of mustard stains is well documented, for instance, Internet pages intended for advice to consumers from companies engaged in carpet cleaning and carpet-cleaning products may be cited.

At http://www.webopages.com/plush/mustard.html, Plush Carpet Cleaning (a carpet cleaning company in Utah) provides a "Do-it-yourself Spot Removal Guide", and, in the entry for mustard stains, suggests, extensive soaking with detergent solutions and cautious bleaching, but concludes, "Mustard stains are practically impossible to remove from some synthetic materials." At http://www.fabriclink.com/carpet/untreatable.html sponsored by Wear-Dated fibers from Solutia (formerly Monsanto) mustard with turmeric is listed among stains "that cannot be removed", since such stains have permanently altered the carpet's color. The advice concludes "Most likely the only solution is to insert carpet from a closet, or some other area into the area where the spot is cut out." At http://www.marsons.com/spspt.html, Marsons (a carpet cleaning company) provides a spot cleaning guide, including for mustard: "Because it contains a disperse dye, mustard is very difficult to totally remove if not impossible!"

Elsewhere, in "Today's Chemist" (February 2000, p. 112), the opinion of Pat Slavin, Manager of Consumer Report's Textile Testing Laboratory (Yonkers N.Y.) is reported. Slavin was quoted therein as saying a procedure for removing mustard stains from clothing was to wash the fabric with soap and water followed by placement of the fabric in sunlight to fade the stain. Such a process is impractical for carpeting in many instances, for example if the stain is on a large or fitted carpet. Various cleaning agents (including peroxide) for removing carpet stains have been described in the patent literature. However, mustard is not discussed specifically, nor is any combination cleaning with light reported.

Clearly there is a need for a better method for the removal of turmeric stains, such as mustard stains, that can be used on carpets and other fabrics. The present invention provides such a process.

SUMMARY OF THE INVENTION

The present invention comprises a process for removing turmeric stains from nylon or wool articles comprising (a) applying a solution of an oxidizing agent to the stained area, and (b) exposing the stained area to light of ultraviolet wavelength.

DETAILED DESCRIPTION

Tradenames and trademarks are indicated herein by capitalization. The term "turmeric stain" as used herein means yellow turmeric stains from any source. Yellow turmeric stains are found in various foods in addition to mustard, such as chicken soup, pickles, and spicy sauces. Such stains can be removed completely by the process of this invention.

This invention comprises a process for the effective removal of stains, particularly colored organic stains such as that from turmeric, that are resistant to simple washing, wiping, or the use of detergent-based spot stain removers. The process of this invention is directed towards nylon 6, nylon 66, and wool fabrics, such as carpets and textiles, including upholstery, and clothing, etc. Fibers such as polyester and polypropylene are not stained by turmeric; spills can be removed with detergent and water. The process of this invention is to use an ultraviolet (UV) lamp in conjuction and simultaneously with an aqueous solution of hydrogen peroxide. The process of this invention causes the yellow stain completely and rapidly to disappear without changing the color of the surrounding, unstained carpet or other fabric. The process of this invention provides major advantages and conveniences over prior art procedures. For instance, compared with sunlight bleaching, the process of this invention allows stain removal without moving the carpet or fabric outside into sunlight or waiting for sunshine. The process of this invention uses readily available hydrogen peroxide solution and affords easily controlled exposure to just the stained area without exposure to undesirable outdoor conditions such as humidity, pollen, insects, bird and other animals, temperature extremes, and unpredictable weather changes. By the use of a long wavelength UV lamp, the shorter wavelength UV light most damaging to fabrics is avoided. Finally the process of this invention is readily limited to just the stained areas of the carpet or other fabric, minimizing any effect on the overall carpet or fabric. Aggressive cleaning agents such as bleach remove not only the turmeric stain but the dyes and colors in the carpet or other fabric. Mild cleaning agents alone are not effective at removing the tough turmeric stain. The combination of the hydrogen peroxide and the long wavelength UV light is demonstrably more effective than either process alone.

The UV lamps suitable for the process of this invention are battery- or alternating current-powered lamps emitting UV light. UV radiation ranges are commonly described as UV-A (400–320 nm, biologically relatively benign), UV-B (320–290 nm, biologically damaging), and UV-C (less than 290 nm, very damaging but absent in sunlight at sea level). While all these wavelengths can be used in the practice of this invention, the longer wavelengths of the UV-A range such as from about 320 nm to about 400 nm, are preferred to minimize risk of carpet or other fabric damage and for reasons of safety. Long wavelength UV lamps, i.e. those emitting a band of radiation centered near 365 nm, were found to provide effective removal of the turmeric stain without posing a hazard to those practicing this invention and also without damaging the carpet or article. Shorter wavelength UV light risks harming eyesight, biological tissue, the stained surface, fabric and fabric color. Light emitted in the visible region of the electromagnetic spectrum (greater than 400 nm) is less effective at removing the turmeric stain. Some powerful visible lights can emit enough light in the long wavelength UV region of the spectrum to remove the stain. The amount of UV light exposure time necessary to remove the turmeric stain will depend on the power of the lamp as well as the lamp's emission spectrum. Low wattage lamps will require extended exposure times. A 100-watt, long wavelength lamp manufactured by UVP effectively removes a mustard stain in approximately 10 minutes. Two examples of suitable UV lamps are provided in the Materials Section below, but the process of this invention is not dependant on the use of specific long wavelength UV lamps.

Suitable aqueous hydrogen peroxide solutions are those containing 3% to 27% by weight hydrogen peroxide, with the most preferred range of 10% to 20%. Higher concentrations of hydrogen peroxide pose an unnecessary hazard to those practicing this invention and risk damaging the carpet or other fabric. Lower concentrations of hydrogen peroxide may require many repeated cycles of treatment followed by UV exposure to remove all of the turmeric stain. For this invention, the hydrogen peroxide solution effectively removed the turmeric stain across the pH range of 2 to 10. The amount of hydrogen peroxide solution used in the cleaning process of this invention is an amount sufficient to wet thoroughly, but not saturate, the stained area. The use of a saturating amount causes the hydrogen peroxide solution to spread excessively into the surrounding unstained carpeting or fabric and should be avoided. However, if the stained area is not thoroughly wetted, additional repeated UV exposure cycles may be required. The amount of hydrogen peroxide solution necessary to thoroughly wet a stained area on the carpet or fabric depends on the size of the stain and the carpet or fabric construction, i.e., heavier carpets or fabrics and larger stains require greater amounts of hydrogen peroxide solution.

For most carpets and other fabrics, enough UV light aches the base or root of the carpet or fabric pile to eliminate the stain along the entire length of the tuft. For thick or dense pile carpets and other fabrics, it may be necessary to open the pile sufficiently to allow the UV light to reach the base or root of the pile. Any method for assisting the UV light to penetrate deeper into the pile after the hydrogen peroxide treatment may be used, such as brushing the pile or folding the pile back with clips.

Carpets and fabrics are colored with a wide variety of dyes and pigments. Some colorants such as pigments can better maintain their color on exposure to strong oxidizing agents. Most nylon carpeting is dyed with acid dyes that are readily bleached on exposure to strong oxidizing agents. The poor colorfastness of most nylon carpets to oxidizing agents limits the choice of cleaning agents for mustard stains. Oxidizing agents such as bleach (NaOCl), sodium persulfate ($Na_2S_2O_8$), and OXONE (potassium monopersulfate compound available from Aldrich, Milwaukee, Wis.) remove not only the color of the turmeric stain but also the color from the dyes in the carpet or article. Some weaker oxidizing agents such as sodium bisulfite ($NaHSO_3$) are ineffective in removing the color from the turmeric stain. Hydrogen peroxide and UV light work together to remove the yellow color without affecting the dyes of most carpets and other fabrics.

In the practice of this invention, turmeric stains are removed by a conventional spill cleanup [steps (a)–(d)], the stain removal process of this invention [steps (e) and (f)], and finally a conventional rinse and vacuum drying [step (g)]. The term "vacuum drying" as used herein refers to a conventional process for removing water from the carpet with a household wet vacuum cleaner, which extracts the water with mechanical suction until the carpet's water content is approximately 40% to 60% of the carpet's dry weight. These values are typical for most mechanical extraction methods and are approximately equivalent to the spin cycle in a household washing machine. Carpet with a moisture range of 40%–60% would typically be described as "damp" and the exact residual moisture level after vacuum drying is not critical to the invention or the mustard cleaning results. The conventional spill cleanup as practiced in the examples involves (a) scraping off the excess mustard or other source of stain, (b) rinsing the stained area with water, (c) cleaning with a detergent solution of 5 grams of TIDE or other liquid laundry detergent in two liters of water, (d) rinsing with water and vacuum drying. The stain removal process of this invention comprises (e) applying a solution of hydrogen peroxide to the stained area, and (f) exposing the stained area to UV light. The process of this invention further comprises, after steps (e) and (f) above, (g) rinsing with water to remove any residual oxidizing agent and optionally vacuum drying. Repeating steps (e), (i), and (g) may be required for a severe turmeric stain. While the process of this invention has been found to be compatible with most stained substrates, a pretest for color-fastness is recommended on an inconspicuous area of the carpet or fabric to be cleaned.

TEST METHODS

Test Method 1. Stain Rating.

A visual rating turmeric stain of 10 (complete stain removal) to 1

1 (maximum or unchanged stain) was used that approximated the AATCC Red 40 Stain Scale (Test Method #175) with the turmeric stains having the same discoloration as the numbered colored film, though discoloration of the turmeric stain was yellow while the discoloration of AATCC Red 40 Stain Scale was red. In practice, a rating of at least 8 and preferably 9 to 10 is desirable. Samples were air dried until no longer damp prior to evaluating the stain by this Test Method.

Test Method 2. Conventional Mustard Stain Generation and Stain Removal Process.

For all mustard stains, five grams of French's Yellow mustard were used to create a stain by placing the mustard on the carpet or other fabric and pressing the stain into the surface. After setting for one hour, the excess mustard was (a) scraped oz. (b) rinsed with water, (c) cleaned with a detergent solution of 5 grams of TIDE liquid laundry detergent in two liters of water, and (d) rinsed with water and vacuum dried. The mustard stain obtained by this procedure prior to treatment with any oxidizing agent and/or exposure to UV light was rated a "2" on the rating scale of Test Method 1 for the carpet or article. (TIDE detergent and the 5 g/2 liter concentration was used to standardize the procedure, other detergents and concentrations may be substituted.) Except as specified in Test Method 1, carpets were subjected to vacuum drying as defined above prior to hydrogen peroxide and UV light exposure to simulate actual use.

MATERIALS

1. Carpets: All carpet samples except D are nylon 66, sample D is nylon 6. Carpets A–E were obtained from Carpets of Dalton, Dalton Ga., carpets F and G were obtained from E. I. du Pont de Nemours and Co., Dalton Ga.

Samples of the following carpets were used:

(A). FOREST PARK (DuPont STAINMASTER brand) made by Mohawk Industries—green colored (B). MAGNIFIQUE (DuPont STAINMASTER brand) made by Aladdin—cream colored (C). TRANQUILITY (DuPont STAIMMASTER brand) made by Queen—gray colored (D). CELESTIAL (Allied ANSO brand) made by Coronet—blue colored (E). TRULY UNIQUE (DuPont STAINMASTER brand) made by Columbus beige colored (F). LUMENA carpet, level loop carpet made by air entangling three yarns of DuPont Solution Dyed LUMENA (C567 Tourmaline; C169 Lt. Steel gray; C289 Ivory and not treated with any fluorochemical or stainblocker protectants).

(G). Untreated Nylon, level loop carpet made from DuPont 1245 nylon yarn, cream colored and not treated with any fluorochemical or stainblocker protectants.

2. Other Nylon and Wool Substrates (H) Men's dress sock by Farah (99% nylon)—blue colored.

(I) Merino sock by Ducks Unlimited (90% wool)—tan colored.

(J) Knee high hose by No Nonsense (94% nylon)—off-white colored.

3. Lamps (X). UVP model B-100AP 100 watt long wavelength UV without yellow filter; purchased from Thomas Scientific, Swedesboro, N.J.

(Y). Controlled Irradiance Xenon Arc FADE-O-METER model Ci65 with borosilicate inner filter glass filter and soda lime outer filter glass (6,500 watt) controlled for 420 nm irradiance; purchase from Atlas Electronic Devices Co., Chicago, Ill.

EXAMPLES

Examples 1–8

Standard stains were prepared on various substrates using the standard mustard stain procedure described in Test Method 2, steps (a)–(d). After drying, carpet samples were treated with the indicated concentration of hydrogen peroxide solution and irradiated using the Ci65 UV lamp for 60 minutes. A second hydrogen peroxide application and 60 min. exposure was made if significant mustard stain remained. Similarly, stained samples were prepared, and treated with the indicated concentrations of hydrogen peroxide solution and irradiated using the UVP100 UV lamp for 5 minutes. The samples were rinsed and subjected to vacuum drying [step (g)]. Second and third treatments with hydrogen peroxide solution with a 5-min. exposure were made only if significant mustard stain remained from the previous treatment. The stain ratings before and after stain removal were measured according to Test Method 1. Results with the Ci65 UV and UVP100 UV lamps are shown in Tables 1A and 1B, respectively.

Examples 9–10

Standard stains were prepared on nylon and wool socks and nylon hose as described in Test method 2, steps (a)–(d). The mustard stain obtained by this procedure prior to treatment with any oxidizing agent and/or exposure to UV light was also rated a "2" on the rating scale of Test Method 1. The stained samples were treated with the indicated concentration of hydrogen peroxide solution and irradiated with the UVP100 lamp for 5 minutes. The procedure was repeated for 10 or 15 minutes and the samples rinsed, dried, and the stains rated according to Test Method 1. Results are shown in Table 4.

Comparative Examples A–C

Standard stains were prepared on various substrates as described for Examples 1–8. After scraping, each stained sample was rinsed, washed with detergent solution [Test Method 2, steps (b) and (c)], and rinsed, but not dried. The wet stained sample was then irradiated, without the use of hydrogen peroxide, using the Ci65 UV lamp for 60 minutes or the UVPI00 UV lamp for 5 minutes. The samples were rinsed and dried [step (g)]. The stain ratings before and after stain removal were measured according to Test Method 1. Results are shown in Table 2.

Comparative Example D

Standard stains were prepared on various substrates as described for Examples 1–8. The stained samples were treated as shown with the indicated concentration of hydrogen peroxide solution for the periods shown without irradiation from a UV lamp, after which the samples were rinsed and dried. The stain ratings before and after stain removal were measured according to Test Method 1. The cleaning with hydrogen peroxide solution only was repeated three times. Results are shown in Table 3.

TABLE 1A

Stain Removal Results, Using the Ci65 UV Lamp.

| Ex. # | Carpet (Initial Stain Rating 2) | % $H_2O_2$ | pH | Stain Rating After Exposure in minutes 60 | 120 |
|---|---|---|---|---|---|
| 1 | FOREST PARK (A) | 3 | 6 | 7.5 | 9.5 |
| 2 | MAGNIFIQUE (B) | 10 | 6 | 10 | — |
| 3 | TRANQUILITY (C) | 10 | 6 | 8 | — |
| 4 | CELESTIAL (D) | 10 | 6 | 9 | — |

TABLE 1B

Stain Removal Results, Using the UVP100 UV Lamp.

| Ex. # | Carpet (Initial Stain Rating 2) | % $H_2O_2$ | pH | Stain Rating After Exposure in minutes 5 | 10 | 15 |
|---|---|---|---|---|---|---|
| 5 | TRULY UNIQUE (E) | 3 | 3 | 7 | 9 | — |
| 6 | TRULY UNIQUE (E) | 10 | 7 | 8 | 9.5 | — |
| 7 | TRULY UNIQUE (E) | 19 | 4 | 9 | 9.5 | — |
| 8 | TRULY UNIQUE (E) | 27 | 6 | 9 | 9.5 | — |
| 9 | LUMENA (F) | 20 | 4 | 6 | 8 | 9 |
| 10 | Nylon (G) | 20 | 4 | 6 | 8 | 9 |

TABLE 2

Comparative Examples, Stain Removal Results, Using the Ci65 and UVP100 UV Lamps without Hydrogen Peroxide.

| Ex. # | Carpet (Initial Stain Rating 2) | UV lamp type | Stain Rating After Exposure in minutes | | |
|---|---|---|---|---|---|
| | | | 60 min | 120 min | |
| A | FOREST PARK (A) | Ci65 (Y) | 7 | 8 | |
| B | MAGNIFIQUE (B) | Ci65 (Y) | 8 | — | |
| | | | 5 min | 10 min | 15 min |
| C | TRULY UNIQUE (E) | UVP100 (X) | 5.5 | 7 | 8 |

TABLE 3

Comparative Example, Stain Removal Results Using Hydrogen Peroxide without UV Lamp.

| Ex. # | Carpet (Initial Stain Rating 2) | % $H_2O_2$ | pH | Stain Rating After Exposure in minutes 5 min | 10 min | 15 min | 20 min |
|---|---|---|---|---|---|---|---|
| D | TRULY UNIQUE (E) | 27 | 6 | 2 | 2.5 | 2.5 | 2.5 |

The Tables 1A, 1B, 2, and 3 above show that the process of this invention, the use of a combination of hydrogen peroxide in addition to UV light, produces faster and more complete removal of standard mustard stains on a given substrate than either (1) detergents, (2) UV light, or (3) hydrogen peroxide alone.

The stain ratings of Example 3 and Comparative Example B warrant further comment. The stain ratings from Test Method 1 are visual measurements of the overall color change and not quantitative measurements of the stain removal. Example 3 was visually cleaner than Comparative example B after treatment, but the combination of marked differences in color and carpet construction contributed to a common rating of 8. Since Comparative example B was a cream colored carpet, any remaining yellow mustard stain did not significantly change the hue of the carpet In Example 3, the gray colored carpet visually showed a dramatic change in hue from even a slight remaining amount of the yellow mustard stain. Changes in hue affect visual ratings more than changes in either lightness or saturation; see for example AATCC evaluation procedures on measuring color. Another factor that disproportionally affected the visual rating is the luster of the fiber. The bright carpet fibers in Example 3, i.e. fibers that do not contain titanium dioxide or other pigments, transmit more visible light through the carpet tufts thus enhancing visual appearance of any remaining mustard stain. The uncleaned yellow mustard stain in Comparative example B was partially masked by its delustered carpet fibers, containing titanium dioxide. If Comparative example B is compared to Example 2, Example 2 shows superior results due to the presence of the hydrogen peroxide.

TABLE 4

Stain Removal Results for Other Nylon and Wool Substrates, Using the UVP100 UV Lamp

| Ex. | Article | % | | Stain Rating After Exposure in minutes | | |
|---|---|---|---|---|---|---|
| # | (Initial Stain Rating 2) | $H_2O_2$ | pH | 5 min | 10 min | 15 min |
| H | Farah Sock (nylon) | 20 | 4 | 9 | 9.5 | 10 |
| I | Merino sock (wool) | 20 | 4 | 9 | 9.5 | — |
| J | No Nonsense hose (nylon) | 20 | 4 | 9 | 9.5 | — |

Table 4 shows the effectiveness of the process of this invention on other nylon and wool substrates.

What is claimed is:

1. A process for removing turmeric stains from nylon or wool articles comprising (a) applying a solution of an oxidizing agent to the stained area, and (b) exposing the stained area to light of ultraviolet wavelength.

2. The process of claim 1 further comprising rinsing the stained area with water to remove any residual oxidizing agent.

3. The process of claim 1 wherein the oxidizing agent is hydrogen peroxide.

4. The process of claim 1 wherein the light is of wavelength of from about 320 nm to about 400nm.

5. The process of claim 4 wherein the light is of wavelength of about 365 nm.

6. The process of claim 3 wherein the hydrogen peroxide is an aqueous solution containing from about 3% to about 27% by weight hydrogen peroxide.

7. The process of claim 1 wherein the nylon article is selected from the group consisting of carpet and textiles.

* * * * *